United States Patent [19]

Stange et al.

[11] 4,026,542

[45] May 31, 1977

[54] DUAL REGISTRATION APPARATUS

[75] Inventors: Klaus K. Stange, Pittsford; Richard E. Smith, Webster; Thomas J. Hamlin, Macedon; James R. Cassano, Penfield, all of N.Y.

[73] Assignee: Xerox Corporation, Stamford, Conn.

[22] Filed: Nov. 28, 1975

[21] Appl. No.: 636,335

[52] U.S. Cl. ..... 271/236; 271/244; 271/195

[51] Int. Cl.[2] ..... B65H 9/00

[58] Field of Search ..... 271/194, 195, 231, 235, 271/236, 238, 243, 244, 245, 264; 226/7, 97

[56] References Cited

UNITED STATES PATENTS

| | | | |
|---|---|---|---|
| 3,405,977 | 10/1968 | Albright | 271/195 X |
| 3,624,807 | 11/1971 | Schwebel | 271/236 |
| 3,918,706 | 11/1975 | Craft | 271/250 |
| 3,926,426 | 12/1975 | Toriumi | 271/236 X |

*Primary Examiner*—Richard A. Schracher
*Attorney, Agent, or Firm*—James J. Ralabate; Carlos Nieves

[57] ABSTRACT

Apparatus for registering a pair of rectangular sheets includes a rectangular sleeve whose width is variable, and a retractable gate located at one end of the sleeve. In a first embodiment, fluid injected into the other end of the sleeve provides first and second fluid streams which register one of the sheets with the gate and one of the narrow walls of the sleeve, and register the other of the sheets with the gate and the other narrow wall of the sleeve. In a second embodiment, the sheets are registered against a centrally disposed vented manifold and the gate. In a third embodiment, fluid drawn into the sleeve provides first and second fluid streams which register one of the sheets with the gate and one of the narrow walls, and register the other of the sheets with the gate and the other of the narrow walls.

13 Claims, 5 Drawing Figures

DUAL REGISTRATION APPARATUS

The subject invention relates to transports which register articles and, more particularly, to fluidic transports, such as disclosed in co-pending U.S. Patent application Ser. No. 627,570, A Registration Station, filed on Oct. 3, 1975, on an invention by Klaus K. Stange et al, the application being assigned to the assignee herein, Xerox Corporation.

The use of fluid to move articles into registration with stops is a part of the public prior art which is relevant herein. In fact, such use of fluids is disclosed in U.S. Pat. No. 3,588,096, issued to Leigh D. Leiter on June 28, 1971. More particularly, the patent discloses apparatus wherein fabric is delivered to a horizontally disposed support including recessed areas housing upwardly pointed nozzles. The nozzles are aligned in two different directions, and the nozzles pointing in one direction are alternately actuated with respect to the nozzles pointing in the other direction to move the fabric into registration in perpendicular directions. Further, the use of fluids for rectilinearly moving an article within a conduit or chamber is also known. In fact, this concept is disclosed in U.S. Pat. No. 3,422,411, issued to J. E. Smith, Jr., on Jan. 14, 1969. More specifically, this patent discloses a data storage cartridge which has an enclosed transfer chamber housing a data storage card. Air pressure and vacuum pressure are switched between opposite ends of the chamber to reciprocally move the card rectilinearly in the chamber.

It is noted that with the apparatus disclosed by Leigh D. Leiter as fabric is advanced, or when fabric which is smaller than the distance between nozzles is to be registered, some of the nozzles discharge into the surrounding air without having any effect on the fabric as it is moved into registration. Therefore, the apparatus is inefficient. In addition, it is noted that in the system disclosed by J. E. Smith, Jr., lateral registration is provided by the distance between walls of the chamber which are parallel to the direction of travel of the storage card. Thus, the system cannot be used with cards having different width dimensions.

It is an object of the present invention to provide apparatus for registering a first sheet with a first set of orthogonally related surfaces and a second sheet with a second set of orthogonally related surfaces, each sheet having a length and width within predetermined ranges.

It is another object of the present invention to provide apparatus for efficiently moving sheets into registration with perpendicularly related surfaces.

Still another object of the present invention is to provide fluidic registration apparatus wherein rectangular sheets may be posed adjacently within a rectangular area.

Briefly, the invention disclosed herein may be used for registering a first sheet with a first set of orthogonally related surfaces and a second sheet with a second set of orthogonally related surfaces. Structurally, the invention may be implemented with (a) a sleeve for internally accommodating said sheets, one surface of each of said sets being located within the sleeve; (b) a retractable gate located at one end of the sleeve, the other surface of each of said sets being located on the gate; and (c) means for providing in the sleeve a first fluid stream having velocity components normal to the first set of surfaces and a second fluid stream having velocity components normal to the second set of surfaces, whereby said streams move a pair of sheets in the sleeve into registration.

Apparatus built according to the invention may be used to register flimsy sheets, such as thin paper. Advantageously, loose particles undesirably located on either side of the sheets are removed from the sheets during transportation.

Additional objects and features of the invention will become apparent by reference to the following description in conjunction with the accompanying drawings, in which.

Figure 1:
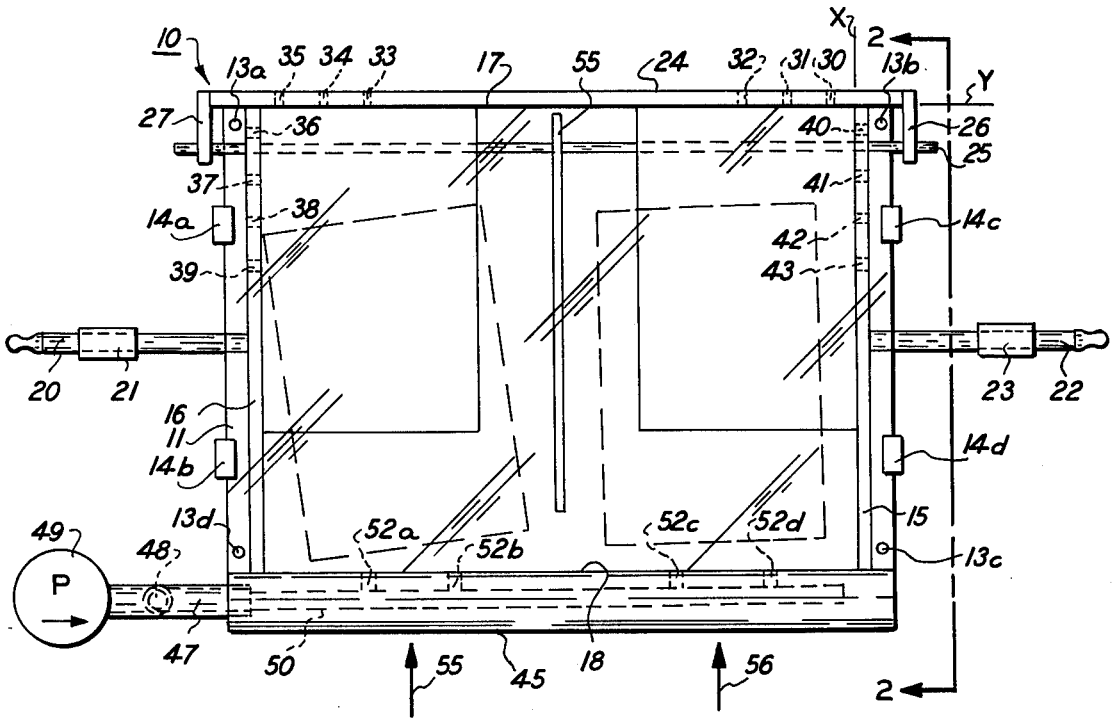
FIG. 1 is a top plan view of registration apparatus, according to the invention, sheets being shown therein unregistered positions (dotted lines) and in registered positions.
Figure 2:
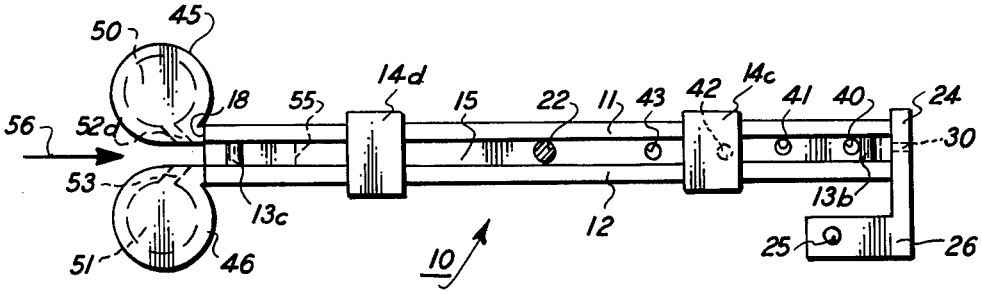
FIG. 2 is a cross-sectional view of the registration apparatus, taken along line 2—2 in FIG. 1.

Registration apparatus 10, according to the invention, is shown in FIGS. 1 and 2. Typically, the apparatus includes a pair of structurally identical rectangular plates 11 and 12, a number of spacers 13*a*-1 3*d* located between the plates and clamps 14*a*–14*d* for securing the spaced plates in parallel. Between the plates 11 and 12, there is located in parallel a pair of elongated rectangular members 15 and 16 coterminous with the plates at ends 17 and 18, each of the members being in sliding contact with the plates and cooperating therewith to provide a sleeve having movable narrow walls. Member 16 is coupled to a rod 20 slidably mounted in a fixed collar 21, the rod having a handle at one end for pushing the member in a direction which is perpendicular to the direction in which it extends, and member 15 is similarly coupled to another rod 22 and collar 23. It should be appreciated that other means may be used for moving members 15 and 16. As a result, the width of the sleeve may be varied. Adjacent end 17, there is located a retractable gate having an abutment 24, a rotatable rod 25, and brackets 26 and 27 coupling the rod 25 to the abutment 24. Rod 22 is used to bring the abutment into contact with end 17, thereby closing off end 17 of the sleeve, or to move the abutment away from end 17. The abutment 24 includes a plurality of ports 30–35 communicating with the space in the sleeve when the abutment is moved against end 20. Elongated member 16 includes a member of ports 36–39 communicating with the space in the sleeve, the ports 33–35 in the gate and the ports 36–39 being located adjacent a common corner when the abutment is against end 17. Similarly, elongated member 15 includes a number of ports 40–43 communicating with the space in the sleeve, the ports 30–32 in the gate and the ports 40–43 being located adjacent another common corner when the abutment is against end 17. When the gate is closed, the abutment is perpendicularly disposed with regard to the elongated members and, therefore, the common corners may be aligned with X and Y directions. The top and bottom plates are spaced from each other by approximately one-sixteenth of an inch, and sheets of paper may be move into the sleeve as is indicated by arrows 55 and 56 and the dotted lines. If thereafter, a pump arrangement directs fluid into the open end of the sleeve, first and second fluid streams flowing through the sleeve will float the sheets into registration at the common corners. Typically, the pump arrangement includes a pair of manifolds 45 and 46 coupled to plates 11 and 12, respectively, the manifolds being coupled by conduits 47 and 48 to a pump 49 and having chambers 50 and 51 with holes 52*a–d* and 53 (not all shown) aligned to inject fluid into the sleeve. To move the sheet out of registration, the gate may be opened, and fluid may be used to move the pair of sheets out of the sleeve through end 17. In this embodiment, the top and bottom plates are manufactured from glass. Thus, sheets brought into registration may be read, may be photographed, or may be scanned with suitable equipment.

In the apparatus described above, a wall 55 may be inserted in the sleeve so as to provide two compartments, the wall being so located to prevent any fluid migration.

It should be appreciated that elongated members 15 and 16 may be moved to align sheets to be registered within a particular area or to accommodate, with limited degrees of freedom, sheets of various sizes.

The registration apparatus disclosed above may be modified or supplemented in a number of ways, some of which are set forth below. In describing the various embodiments, similar reference numerals will be used to designate components previously described.

Figure 3:
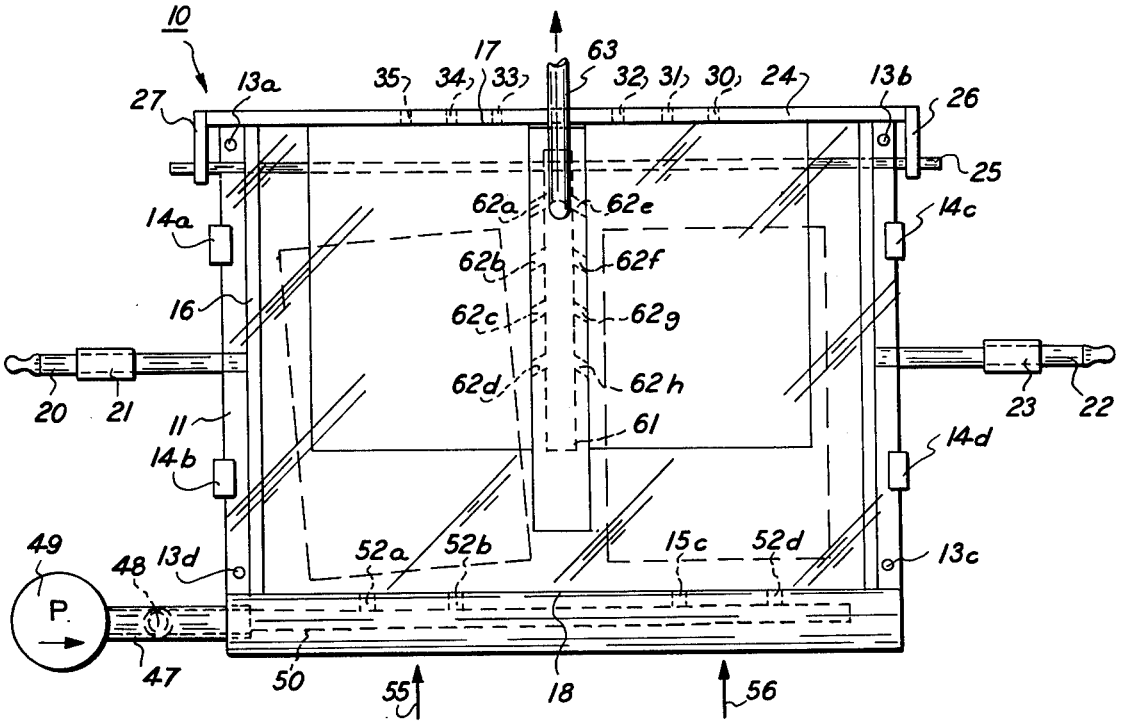
FIG. 3 is a top plan view of another embodiment of registration apparatus, according to the invention, sheets being shown therein in unregistered positions (dotted line) and in a registered positions.

Referring to FIGS. 1 and 3, it may be seen that registration apparatus shown in FIG. 3 differs from that shown in FIG. 1 in the ports 36–43 have been eliminated, ports 30–35 have been shifted towards the center of the sleeve, and wall 55 has been replaced with a manifold 60 having a chamber 61. Manifold 60 includes a plurality of holes 62*a–d*, extending from the chamber, communicating with one compartment of the space in the sleeve it divides; another plurality of holes 62*e–h*, extending from the chamber, communicating with the other compartment of the space in the sleeve it divides, and a hole coupled to a tube 63 extending through the plate 11 for venting the chamber. With this arrangement, the fluid injected into the sleeve exits through holes 30–35 and 62*a–h* and in the process registers sheets in the compartments against the abutment 24 and the walls of the manifold.

Figure 5:
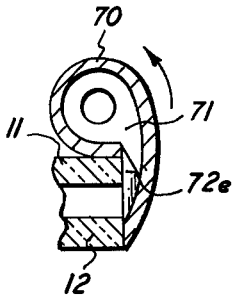
FIG. 5 is a partial cross-sectional view of registration apparatus, taken along line 5—5 in FIG. 4. -13
Figure 4:
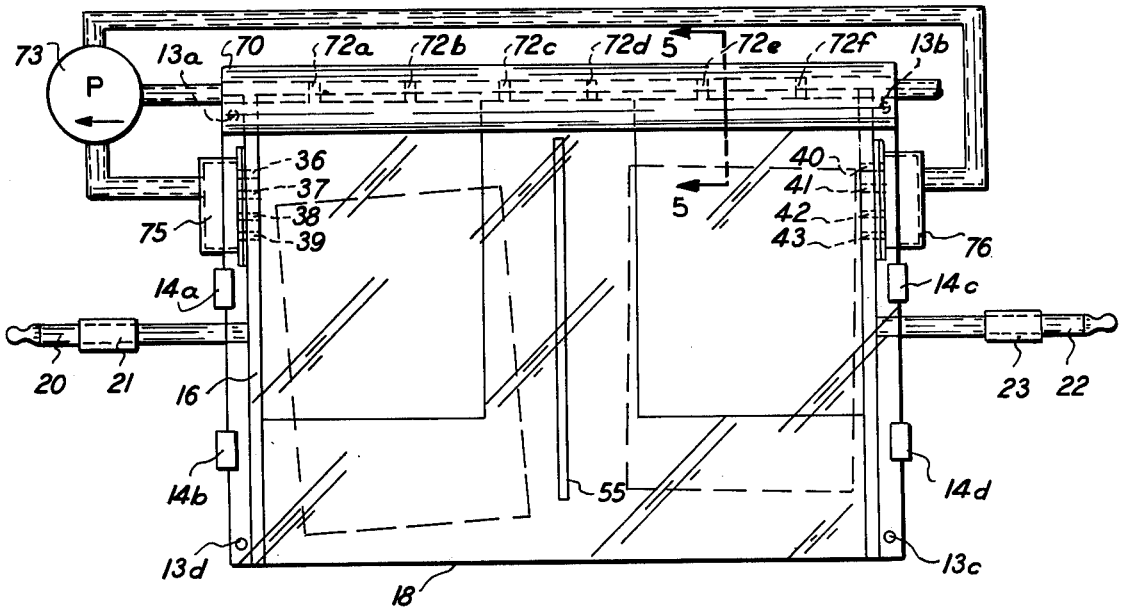
FIG. 4 is a top plan view of still another embodiment of registration apparatus, according to the invention.

Referring to FIGS. 1, 4, and 5, it may be seen that registration apparatus shown in FIGS. 4 and 5 differs from that shown in FIG. 1 in that the pump 49 and manifolds 45 and 46 have been eliminated. Moreover, in this embodiment, the gate is a rotatable manifold 70 having a chamber 71 which may be positioned in communication with the space in the sleeve end 17, and a plurality of ribs 72*a–f* in the chamber serve as abutments. Chamber 71 is coupled to a vacuum pump 73. Pump 73 is coupled to a manifold 75 fixed to member 16 and having a chamber communicating with ports 36–39 and to manifold 76 fixed to member 15 having a chamber communicating with ports 40–43. As a result, when sheets are placed in the sleeve and pump 73 is turned on, fluid streams are set up in the sleeve which move one sheet into registration with the gate and member 16 and move the other sheet into registration with the gate and member 15.

From the foregoing, it will be appreciated that a pair of sheets may be registered within a sleeve either with jets of fluid or with a vacuum source.

It is to be understood that the description herein of preferred embodiments according to the invention, have been set forth as examples thereof and are not to be construed or interpreted as limitations on the claims which follow and define the invention.

What is claimed is:

1. Apparatus for registering a first sheet with a first set of orthogonally related surfaces and a second sheet with a second set of orthogonally related surfaces, each sheet having a length and width within predetermined ranges, comprising:

a. a sleeve for internally accommodating said sheets, one surface of each of said sets being located within the sleeve;

b. a retractable gate located at one end of the sleeve, the other surface of each of said sets being located on the gate; and c. means for providing in the sleeve a first fluid stream having velocity components normal to the first set of surfaces and a second fluid stream having velocity components normal to the second set of surfaces, whereby said streams move a pair of sheets in the sleeve into registration.

2. Apparatus as defined in claim 1 wherein said means for providing first and second fluid streams in the sleeve includes means for injecting said first and second streams.

3. Apparatus as defined in claim 2 wherein said means for providing first and second fluid streams includes a plurality of ports in said gate.

4. Apparatus as defined in claim 3 wherein said means for providing first and second fluid streams further includes a number of ports in one narrow wall of the sleeve and another number of ports in the other narrow wall of the sleeve.

5. Apparatus as defined in claim 4 wherein at least one of the narrow walls is movably mounted and further including means for moving said at least one narrow wall.

6. Apparatus as defined in claim 4 further including a wall, in the sleeve, for dividing the sleeve to provide two compartments.

7. Apparatus as defined in claim 3 wherein said means for providing first and second fluid streams further includes: a manifold located in the sleeve and dividing the inside of the sleeve into two compartments, the manifold having a chamber communicating with each of the compartments via a plurality of holes; and means for venting the chamber.

8. Apparatus as defined in claim 7 wherein at least one of the narrow walls is movably mounted and further including means for moving said at least one narrow wall.

9. Apparatus as defined in claim 1 wherein said means for providing first and second fluid streams in the sleeve include a vacuum pump.

10. Apparatus as defined in claim 9 wherein the retractable gate includes a chamber communicating via a number of holes with the space in the sleeve and means for coupling the chamber to the vacuum pump.

11. Apparatus as defined in claim 10 wherein said means for providing first and second fluid streams includes a number of ports in one narrow wall of the sleeve; another number of ports in the other narrow wall of the sleeve; a first manifold coupled to the pump and having a chamber commumicating with said number of ports; and a second manifold coupled to the pump and having a chamber communicating with said another number of ports.

12. Apparatus as defined in claim 11 further including a wall in the sleeve for dividing the sleeve to provide two compartments.

13. Apparatus as defined in claim 11 wherein at least one of the narrow walls is movably mounted and further including means for moving said at least one narrow wall.

* * * * *